United States Patent [19]

Allekotte et al.

[11] Patent Number: 4,989,122

[45] Date of Patent: Jan. 29, 1991

[54] LIGHT BOX

[75] Inventors: Heinz A. Allekotte, Cologne; Gerd Sturm, Leverkusen, both of Fed. Rep. of Germany

[73] Assignee: Marketing-Displays, Fed. Rep. of Germany

[21] Appl. No.: 384,378

[22] Filed: Jul. 25, 1989

[30] Foreign Application Priority Data

May 13, 1989 [DE] Fed. Rep. of Germany ... 8906016[U]

[51] Int. Cl.[5] ..... G09F 13/04; F21V 7/04

[52] U.S. Cl. ..... 362/97; 362/225; 362/256; 362/346

[58] Field of Search ..... 362/31, 225, 255, 256, 362/346, 97

[56] References Cited

U.S. PATENT DOCUMENTS

| | | | |
|---|---|---|---|
| 2,295,994 | 9/1942 | Howe | 362/97 |
| 2,529,713 | 11/1950 | Thurston | 362/31 |
| 4,536,830 | 8/1985 | Wisniewski | 362/225 |
| 4,630,895 | 12/1986 | Abdala | 362/31 |

FOREIGN PATENT DOCUMENTS

| | | | |
|---|---|---|---|
| 221018 | 5/1987 | European Pat. Off. | 362/97 |
| 317439 | 5/1934 | Italy | 362/97 |

*Primary Examiner*—Douglas Hart

*Attorney, Agent, or Firm*—Diller, Ramik & Wight

[57] ABSTRACT

A light box particularly adapted to back-light posters which includes a housing having a back wall, a peripheral wall and an opening opposite the back wall; a diffuser panel spanning the opening, an elongated lamp within the housing adjacent the peripheral wall for emitting radiation from the lamp peripherally inward toward the back wall and the diffuser panel, and first and second reflector surfaces respectively adjacent and more remote from the lamp with the first reflector surface having reflecting capabilities which are less then the reflecting capabilities of the second reflector surface. The lamp has material contiguous thereto for preventing emitted radiation directed from the lamp directly toward the diffuser panel from impinging upon the diffuser panel whereby bright spots on the back-lit poster are eliminated and the poster is back-lit uniformly over its area.

14 Claims, 1 Drawing Sheet

-1/1-

LIGHT BOX

BACKGROUND OF THE INVENTION

The invention concerns a light box.

Light boxes serve for the affixation of posters. They consist of a box sealed by means of a diffuser panel which normally contains several fluorescent lamps. Posters affixed to the diffuser panel are back-lit by the fluorescent lamps. If the box is deep enough, the lamps can be fitted at a distance from the diffuser panel, but difficulties arise if the box is not very deep. In such cases the light diffusion is uneven, with the result that the position of the lamps can be identified from the outside through the diffuser panel and poster. Places with greater luminance than their surroundings are known as hot spots. The desired effect, of course, is one of optimal even back-lighting of the poster, i.e. even illumination of the diffuser panel.

SUMMARY OF THE INVENTION

The invention is aimed at creating a light box of the type stated in the general definition of claim 1 which with minimum installation depth offers as even a distribution of luminance as possible without local concentrations of light.

This problem is resolved in the invention by the features listed.

The inventive feature of the light box is the screening of the diffuser panel from direct illumination from the lamp. This means that the light from the lamp can only reach the diffuser panel after being reflected at least once. As light from the lamp does not reach the diffuser panel directly, local concentrations of light are avoided. The reflector surfaces can be designed so that light scatter or diffusion is achieved by the fact that in the area farthest from the lamps the light is reflected against the diffuser panel while in the area nearest the lamps, in which the luminance inside the box is in any case greater, less light is reflected towards the diffuser panel. The reflection of the lamp light can be varied by light-absorbing coatings, light-scattering reflector surfaces, etc., or through the shape of the reflector surfaces, which would cause the appropriate light distribution on the diffuser panel.

For preference the lamp is located at one end of the box beneath a screen attached at the edge of the diffuser panel. As the lamp light is reflected relatively evenly into the inside of the box, the light utilisation is improved and hence the number of lamps required and the rating of the lamps reduced. As, for example, an area of 500×900 mm can be illuminated by just two 16 W fluorescent tubes, there is a considerable saving in energy in comparison with conventional designs which require at least twice the wattage to produce the same result. For preference a lamp is located at each of the opposite ends of the box, the variation in luminance in the diffuser panel of a conventionally dimensioned light box being only around 100 lux.

The following section describes a possible implementation of the invention, with reference being made to the drawings.

DESCRIPTION OF THE PREFERRED EMBODIMENTS

Figure 1:
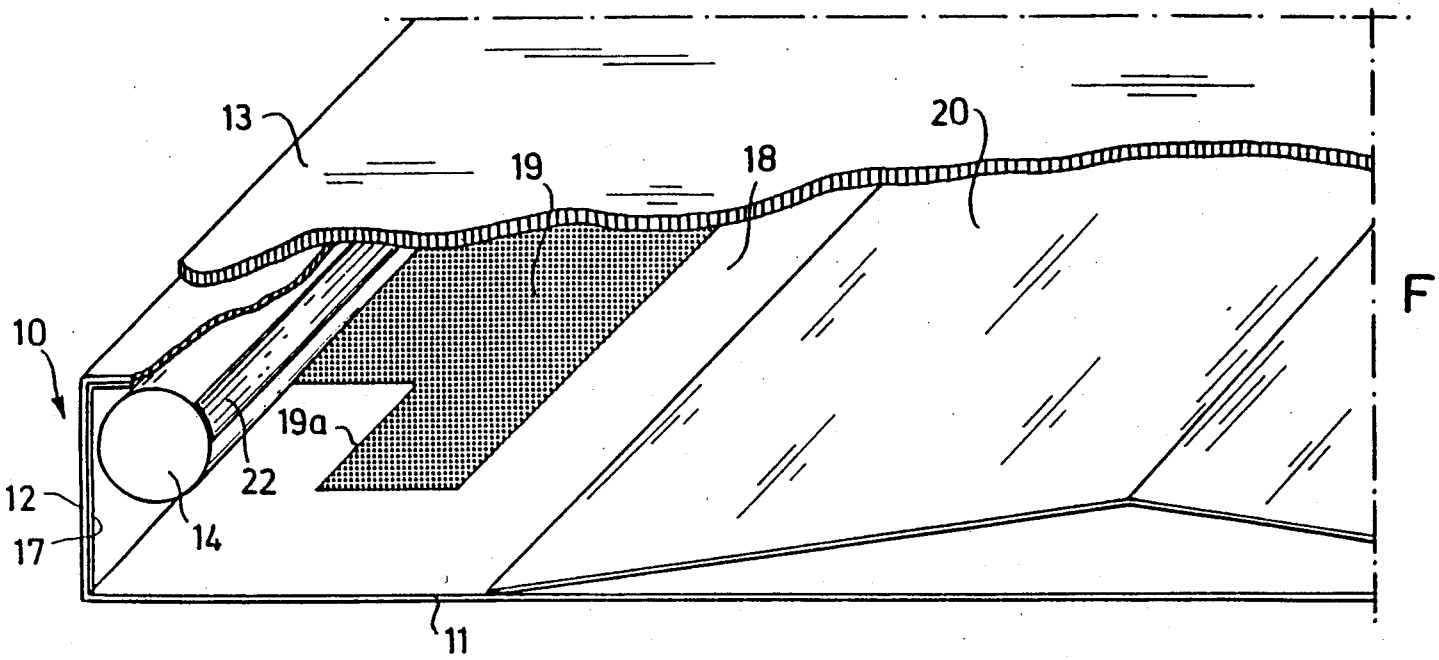
FIG. 1 shows a perspective view of a light box with part section.

The light box comprises a rectangular box 10 with a rear wall 11 and four surrounding sides 12. The open front side is covered by a diffuser panel 13 made, for example, of opal glass. A back-lit poster can be attached to the diffuser panel 13, the poster being covered by a (non-illustrated) transparent panel which is tilted down in front of the diffuser panel and poster.

Long lamps 14, e.g. a fluorescent lamps, are fitted at the upper and lower end of the inside of the box 10 near the respective walls 12. The fluorescent lamps are fitted very close to the diffuser panel 13 but provisions are made to prevent direct light from the fluorescent lamp from reaching the diffuser panel 13. For this purpose an opaque strip 16 is provided next to the wall 12. The diffuser panel 13 is fixed on the outside of the strip 16 which forms a screen between the lamp 14 and the diffuser panel 13. The width of the strip 16 is greater than the diameter of the lamp 14.

Apart from the screen in the form of strip 16 behind the diffuser panel 13, a further screen 22 is fitted on the lamp 14 itself comprising an opaque strip stuck on to the lamp tube which screens the sector directed towards the part of the diffuser panel 13 outside the strip 16. In this way the two screens 16 and 22 combine to screen the entire diffuser panel 13 from direct illumination by the lamp 14.

The wall 12 inside the box 10 is provided with a coating 17 which causes diffuse light reflection. As an alternative the coating 17 can also be provided with a mirror finish.

The inside of the rear wall 11 has a reflector surface 18 which also causes diffuse reflection, i.e. scattering of the reflected light. This reflector surface 18 can consist of a pain finish, for example. In the area near the lamp the rear wall 11 has a reflector surface 19 which, in the example described here, consists of a black matt film covering the coating 18 and causing the diffusely reflected light to be absorbed. This reflector surface 19 extends over an area at least twice the width of the lamp diameter. From lamp 14 the non-absorbing reflector surface 18 joins the absorbing reflector surface 19. In the area farthest from the lamp a mirror-finish surface 20 is fitted on the rear wall 11 and tilted relative to it, causing directed reflection of the impinging lamp light towards the diffuser panel 13.

Figure 2:
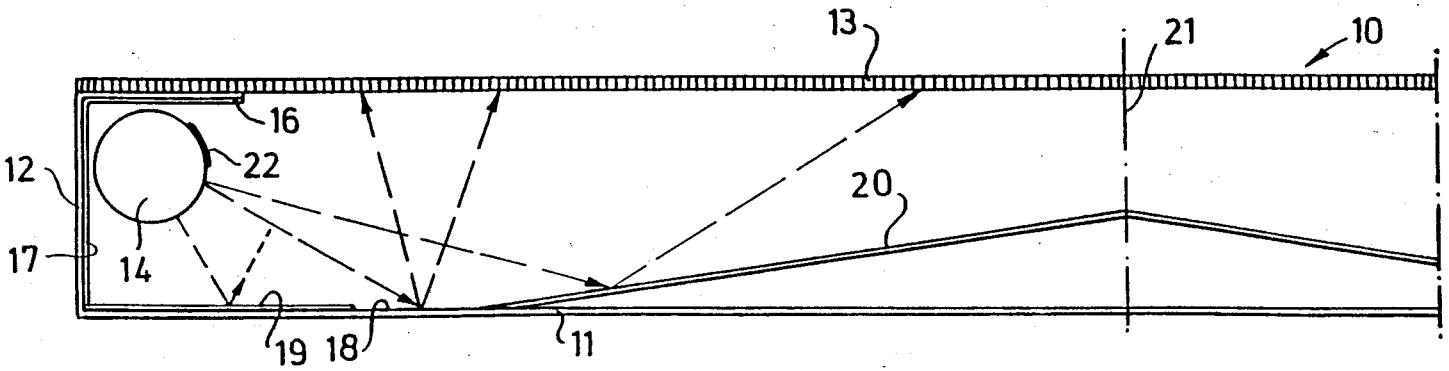
FIG. 2 shows an axial section through the light box in FIG. 1.

In FIG. 2 the middle of the length of the light box is designated by line 21. In principle lamp 14 illuminates one half of the box 10 while the other half of the box is illuminated by a (non-illustrated) lamp fitted at the opposite end and parallel to lamp 14.

As can be seen in FIG. 1 the light-absorbing coating 19 has a cut-out **19*a* near the end of the lamp. This cut-out 19*a*** is provided because the luminance reduces at the ends of a fluorescent lamp. This reduction is compensated by omission of the light-absorbing coating near the ends of the fluorescent lamp.

The light box is longitudinally symmetrical. If it is set up with a vertical diffuser panel, the lamp 14 at the upper end and a second lamp at the lower end are hidden behind the poster frame to hold the poster. As a result of the directed light distribution generally even light diffusion is achieved throughout the entire surface to be illumination, despite the fitting of lamps at the ends of the lamp box.

We claim:

1. A light box particularly adapted for the attachment of back-lit posters comprising a housing having a back wall, a peripheral wall and an opening opposite the back wall; a diffuser panel spanning said opening, an elongated lamp within said housing adjacent said peripheral wall for emitting radiation from the lamp peripherally inward toward said back wall and said diffuser panel, reflector surface means at said back wall for reflecting emitted radiation toward said diffuser panel, means contiguous said lamp for preventing emitted radiation directed from said lamp directly toward said diffuser panel from impinging upon said diffuser panel, said reflector surface means includes first and second reflector surfaces respectively immediately adjacent and more remote from said lamp, said second reflector surface also immediately borders said first reflector surface along a generally common edge remote from said lamp, and said first reflector surface has reflecting capabilities which are less than the reflecting capabilities of said second reflector surface.

2. The light box as defined in claim 1 wherein said reflector surface means is a diffuse reflector surface.

3. The light box as defined in claim 1 wherein said reflector surface means are a pair of diffuse reflector surfaces.

4. The light box as defined in claim 1 wherein said more remote second reflector surface is disposed at an angle to said diffuser panel.

5. The light box as defined in claim 1 wherein said more remote second reflector surface has a mirror finish.

6. The light box as defined in claim 1 wherein said means for preventing emitted radiation impinging upon said diffuser panel is carried by said lamp.

7. The light box as defined in claim 1 wherein said means for preventing emitted radiation from directly impinging upon said diffuser panel is an opaque strip carried by said lamp.

8. The light box as defined in claim 1 wherein said means for preventing emitted radiation from directly impinging upon said diffuser panel is opaque material disposed between said lamp and said diffuser panel.

9. A light box particularly adapted for the attachment of back-lit posters comprising a housing having a back wall, a peripheral wall and an opening opposite the back wall; a diffuser panel spanning said opening, an elongated lamp within said housing adjacent said peripheral wall for emitting radiation from the lamp peripherally inward toward said back wall and said diffuser panel, reflector surface means at said back wall for reflecting emitted radiation toward said diffuser panel, means contiguous said lamp for preventing emitted radiation directed from said lamp directly toward said diffuser panel from impinging upon said diffuser panel, said elongated lamp has a higher light intensity at a median portion thereof than at opposite ends, said reflector surface means includes first and second reflector surfaces respectively adjacent and more remote from said lamp, said first reflector surface has reflecting capabilities which are less than teh reflecting capabilities of said second reflector surface, a first portion of said first reflector surface spans the distance between said lamp ends, and a second portion of said first reflector surface spans said median lamp portion but excludes said lamp ends.

10. A light box particularly adapted for the attachment of back-lit posters comprising a housing having a back wall, a peripheral wall and an opening opposite the back wall; a diffuser panel spanning said opening, an elongated lamp within said housing adjacent said peripheral wall for emitting radiation from the lamp peripherally inward toward said back wall and said diffuser panel, reflector surface means at said back wall for reflecting emitted radiation toward said diffuser panel, means contiguous said lamp for preventing emitted radiation directed from said lamp directly toward said diffuser panel from impinging upon said diffuser panel, said reflector surface means includes first and second reflector surfaces respectively adjacent and more remote from said lamp, said first reflector surface has reflecting capabilities which are less than the reflecting capabilities of said second reflector surface said elongated lamp has a higher light intensity at a median portion thereof than at opposite ends, said reflector surface means includes first and second reflector surfaces respectively adjacent and more remote from said lamp, said first reflector surface has reflecting capabilities which are less than the reflecting capabilities of said second reflector surface, a first portion of said first reflector surface spans the distance between said lamp ends, and a second portion of said first reflector surface spans said mediam lamp portion but excludes said lamp ends.

11. The light box as defined in claim 4 wherein said means for preventing emitted radiation from directly impinging upon said diffuser panel is carried by said lamp.

12. The light box as defined in claim 4 wherein said means for preventing emitted radiation from directly impinging upon said diffuser panel is an opaque strip carried by said lamp.

13. The light box as defined in claim 4 wherein said means for preventing emitted radiation from directly impinging upon said diffuser panel is opaque material disposed between said lamp and said diffuser panel.

14. A light box particularly adapted for the attachment of back-lit posters comprising a housing having a back wall, a peripheral wall and an opening opposite the back wall; a diffuser panel spanning said opening, an elongated lamp within said housing adjacent said peripheral wall for emitting radiation from the lamp peripherally inward toward said back wall and said diffuser panel, reflector surface means at said back wall for reflecting emitted radiation toward said diffuser panel, means contiguous said lamp for preventing emitted radiation directed from said lamp directly toward said diffuser panel from impinging upon said diffuser panel, said reflector surface means includes first and second reflector surfaces respectively adjacent and more remote from said lamp, said more remote second reflector surface is disposed at an angle to said diffuser panel, said elongated lamp has a higher light intensity at a median portion thereof than at opposite ends, said reflector surface means includes first and second reflector surfaces respectively adjacent and more remote from said lamp, said first reflector surface has reflecting capabilities which are less than the reflecting capabilities of said second reflector surface, a first portion of said first reflector surface spans the distance between said lamp ends, and a second portion of said first reflector surface spans said median lamp portion but excludes said lamp ends.

* * * * *